US005989110A

United States Patent [19]

Leifeld

[11] Patent Number: 5,989,110

[45] Date of Patent: Nov. 23, 1999

[54] FLEXIBLE ROLL FOR REMOVING MATERIAL FROM COMPONENTS OF A FIBER PROCESSING MACHINE

[75] Inventor: Ferdinand Leifeld, Kempen, Germany

[73] Assignee: Trützschler GmbH & Co. KG, Mönchengladbach, Germany

[21] Appl. No.: 09/148,627

[22] Filed: Sep. 4, 1998

[30] Foreign Application Priority Data

Sep. 8, 1997 [DE] Germany ..... 197 39 187

[51] Int. Cl.[6] ..... B24B 19/00

[52] U.S. Cl. ..... 451/416; 241/166; 451/424

[58] Field of Search ..... 451/424, 416; 241/166, 167

[56] References Cited

U.S. PATENT DOCUMENTS

| | | | |
|---|---|---|---|
| 861,981 | 7/1907 | Hill | 451/424 |
| 2,849,844 | 9/1958 | Snape | 451/416 |
| 3,228,149 | 1/1966 | Still et al. | 451/424 |
| 3,528,205 | 9/1970 | Roberts . | |
| 4,575,972 | 3/1986 | Ohki et al. . | |
| 4,984,395 | 1/1991 | Demuth . | |

FOREIGN PATENT DOCUMENTS

| | | | |
|---|---|---|---|
| 0 322 637 | 7/1989 | European Pat. Off. . | |
| 1206429 | 2/1960 | France | 451/416 |
| 81003 | 10/1894 | Germany . | |
| 1 137 981 | 10/1962 | Germany . | |
| 196 05 635 | 8/1997 | Germany . | |
| 63-150144 | 6/1988 | Japan | 451/416 |
| 63-295169 | 12/1988 | Japan | 451/416 |
| 1198936 | 7/1970 | United Kingdom . | |

*Primary Examiner*—Mark Rosenbaum
*Attorney, Agent, or Firm*—Venable Gabor J. Kelemen

[57] ABSTRACT

A fiber processing machine includes a fiber processing component and a material-removing roll supported to be in contact with the fiber processing component for removing material therefrom. The material-removing roll includes a radially deformable resilient circumferential surface and a material-removing substance carried at least indirectly by the resilient surface.

17 Claims, 4 Drawing Sheets

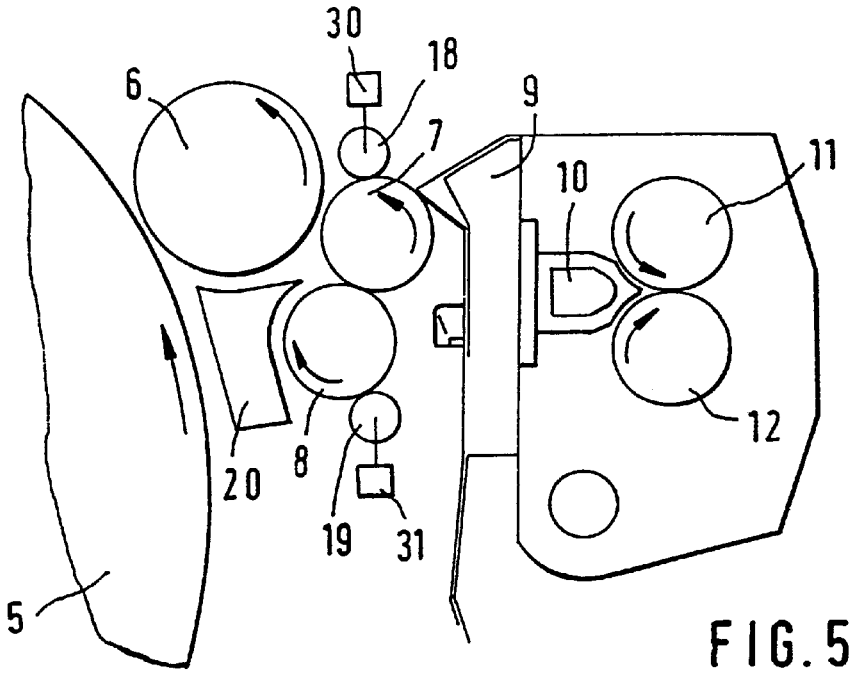
FIG. 5
FIG. 6
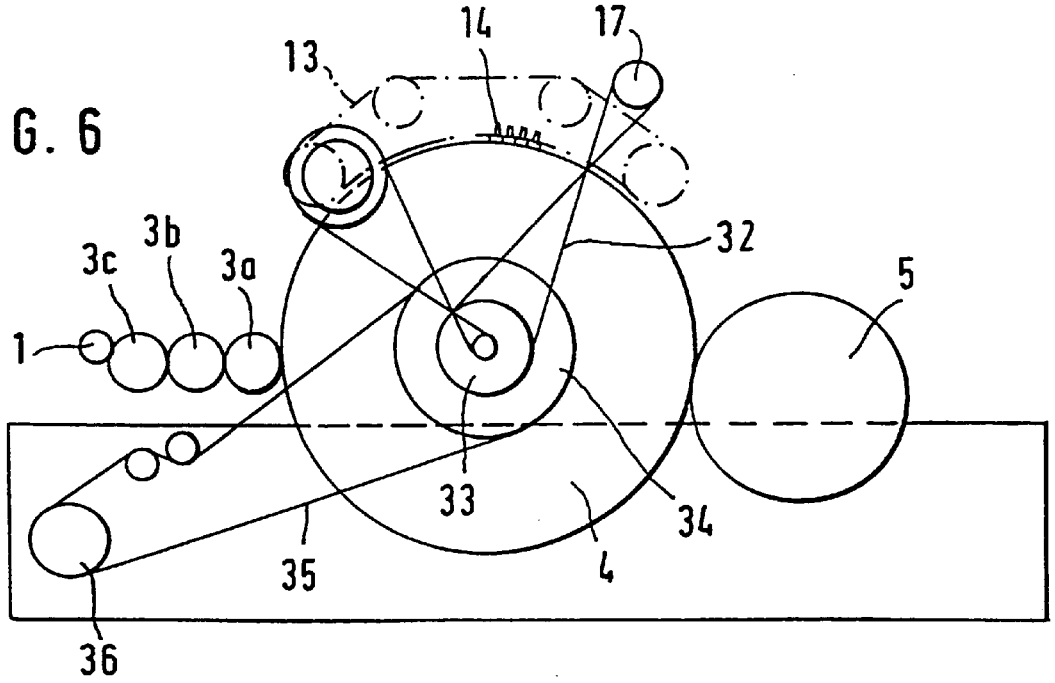

FLEXIBLE ROLL FOR REMOVING MATERIAL FROM COMPONENTS OF A FIBER PROCESSING MACHINE

CROSS REFERENCE TO RELATED APPLICATION

This application claims the priority of German Application No. 197 39 187.7 filed Sep. 8, 1997, which is incorporated herein by reference.

BACKGROUND OF THE INVENTION

This invention relates to a roll for removing material from components of a fiber processing machine, particularly a carding machine, for grinding the clothing points of the flat bars of the traveling flats or for removing dirt from the crushing rolls.

Conventionally, a grinding roll associated with the traveling flats of a carding machine is arranged for rotation about an axis parallel to the longitudinal axis of the flat bars. The circumferential surface of the grinding roll and the travelling flat bars have unlike velocities.

It is known that during operation of the carding machine the clothing points of the flat bars are exposed to slow wear, resulting in the dulling of the points. This causes a deterioration of the operation of the carding machine, and thus the quality of the fiber web produced by the carding machine is adversely affected. Accordingly, it is therefore conventional to grind the clothing points of the flat bars from time to time to restore the points to their necessary sharpness.

The conventional clothing point grinding roll and process, however, have the disadvantage that for the sharpening operation the carding machine has to be stopped, resulting in a certain down time. Further, the grinding roll and its carrier have to be very stable and must be manufactured with the utmost precision. These requirements render the grinding process expensive. Further, the points are ground to a non-uniform extent. It is still another drawback that, viewed over a longer period of time, the quality of the continuously formed web slowly decreases as the clothing points become increasingly dull and after each grinding process the web quality abruptly improves. Such a circumstance makes the manufacture of yarn of uniform properties more difficult as viewed over both short-term and long-term working periods of the carding machine.

In the known grinding process of the flat bar clothing points, rolls are used which have a grinding layer on their rigid circumferential surface. To ensure that during grinding each point of the clothing is ground in an optimal manner, that is, to ensure that from each point neither too little nor too much material is removed, very high requirements are set for the linearity of the grinding roll. To comply with such requirements involves significant expense, rendering the grinding process uneconomical. Also, it is unavoidable that from the individual points excessive or insufficient amount of material is removed because in practice the clothing points are not of uniform height.

SUMMARY OF THE INVENTION

It is an object of the invention to provide an improved material-removing roll of the above-outlined type from which the discussed disadvantages are eliminated and which, in particular, makes possible a significantly improved and uniform grinding of the clothing points of flat bars in a carding machine.

This object and others to become apparent as the specification progresses, are accomplished by the invention, according to which, briefly stated, the fiber processing machine includes a fiber processing component and a material-removing roll supported to be in contact with the fiber processing component for removing material therefrom. The material-removing roll includes a radially deformable resilient circumferential surface and a material-removing substance carried at least indirectly by the resilient surface.

By virtue of the elastic circumferential surface of the grinding roll, such surface is radially deformable and thus the grinding layer conforms to the non-uniform height of the clothing points. As an advantageous result, all points are ground and ground down to a uniform extent. It is a further advantage of the invention that the grinding roll—in contrast to conventional arrangements—is not subject to the same stringent requirements. Since the grinding roll according to the invention makes possible a grinding process during the normal operation of the carding machine, in contrast to the periodic grinding process—in which a slow deterioration of quality of the fiber web and an abrupt improvement of its quality after each grinding process occur—with the use of the invention a sustained evening of the fiber web produced by the carding machine is achieved.

The invention has the following further advantageous features:

- The material-removing roll is supported on stationary bearings.
- The roll support and/or the material-removing roll is adjustable.
- The material-removing roll may conform to the various heights of the points of the flat bar clothing points.
- The material-removing roll has a core made of a hard material, for example, steel, aluminum or plastic carrying an elastic circumferential layer.
- The elastic circumferential layer is an elastic hose or the like made, for example, of foam material, rubber of cellular structure, or foamed silicone.
- The elastic circumferential layer is made of a soft material.
- The elastic circumferential layer contains the grinding or cleaning (polishing) substance.
- The grinding or cleaning substance is applied to the surface of the elastic circumferential layer.
- The grinding or cleaning material is wound on the elastic circumferential layer, for example, as a ribbon.
- The material-removing roll has a circumferential speed of approximately 3–10 m/sec.
- The material-removing roll is intermittently or continuously engaging the flat bar clothings.
- The material-removing roll is arranged downstream of the cleaning device for the traveling flats, as viewed in the advancing direction of the flat bars.
- The direction of motion of the material-removing roll coincides with or is opposite to that of the flat bars in the mutual contacting zone.
- The material-removing roll engages the clothing points of the flat bars under its own weight.
- The grinding or cleaning substance comprises sanding substances such as silicone, corundum, titanium carbide or sanding fibers or comprises polishing elements such as artificial leather.
- The grinding or cleaning substance is applied to a textile carrier (such as a woven or knit fabric) which is mounted about the elastic circumferential layer of the material-removing roll.

The textile carrier is elastic at least in one direction.

The textile carrier has at least partially elastic yarns, such as Elastan.

The material-removing roll is cooperating with a roll cleaning device such as a cleaning roll, a scraper blade or a suction device.

BRIEF DESCRIPTION OF THE DRAWINGS

FIG. 5 is a schematic side elevational view illustrating cleaning rolls according to the invention, cooperating with crushing rolls situated between the doffer and a sliver trumpet of a carding machine.

FIG. 6 is a schematic side elevational view of travelling flats, a grinding roll according to the invention associated therewith as well as a common drive for the travelling flats and the material-removing roll.

DESCRIPTION OF THE PREFERRED EMBODIMENTS

Figure 1:
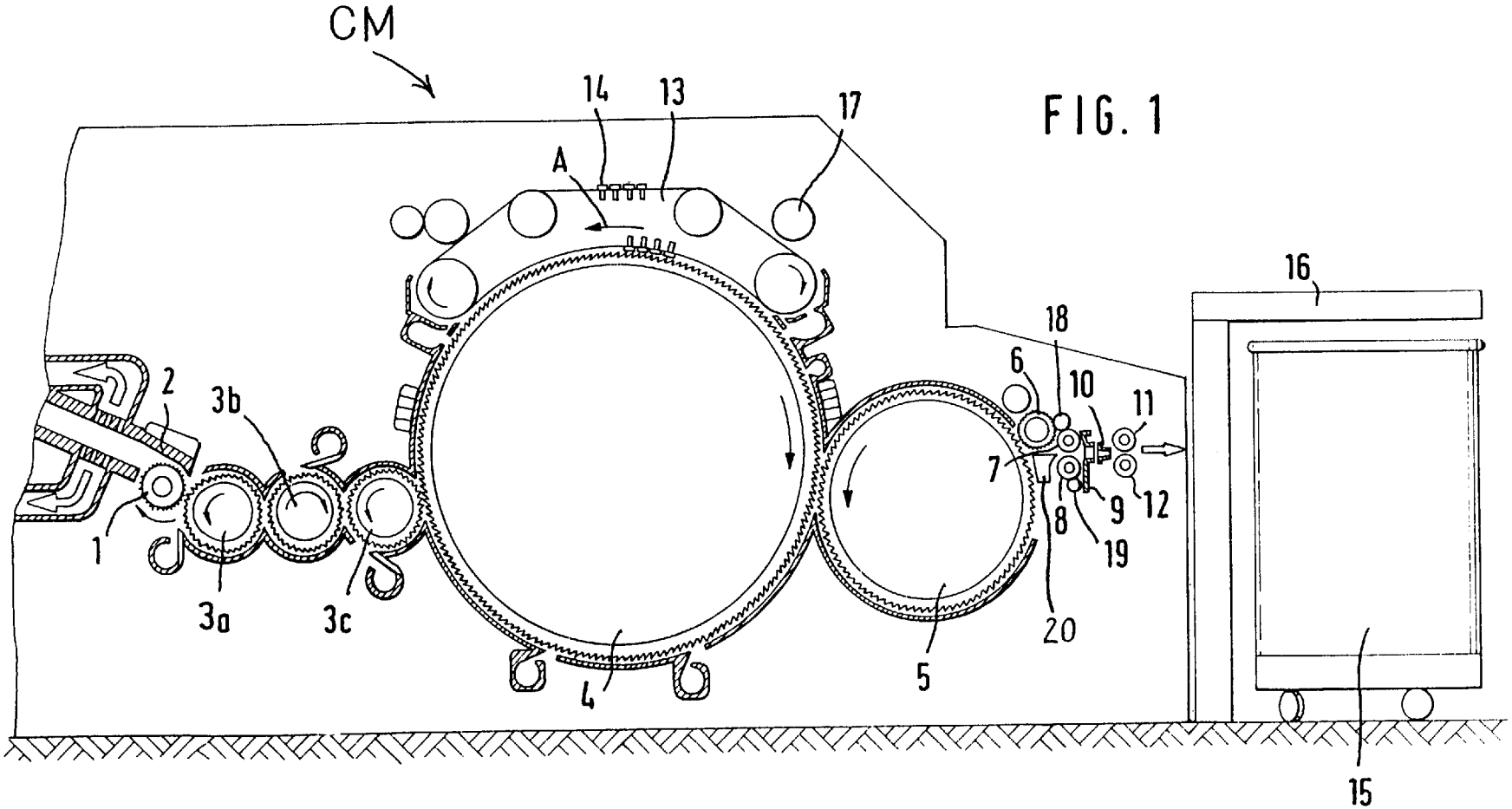
FIG. 1 is a schematic side elevational view of a carding machine incorporating the invention.

FIG. 1 shows a carding machine CM which may be, for example, an EXACTACARD DK 803 model, manufactured by Trützschler GmbH & Co. KG, Mönchengladbach, Germany. The carding machine CM has a feed roll 1 cooperating with a feed tray 2, licker-ins 3*a,* 3*b* and 3*c,* a main carding cylinder 4, a doffer 5, a stripper roll 6, cooperating crushing rolls 7 and 8, a web guiding element 9, a web trumpet 10, cooperating calender rolls 11, 12, traveling flats 13 having flat bars 14, a coiler can 15 and a sliver coiling mechanism 16. The direction of rotations is indicated by curved arrows drawn into the respective rolls. Underneath the stripping roll 6 a profiled element 20 is provided which guides the fiber web into the nip defined by the cooperating crushing rolls 7, 8.

A grinding roll 17 designed according to the invention is provided for the clothings 14*a* of the flat bars 14. Cleaning rolls 18 and 19, also structured according to the invention, cooperate with respective crushing rolls 7 and 8. It is noted that the grinding roll 17 as well as the cleaning rolls 18 and 19 are also collectively referred to as material-removing rolls and designated at R. Arrow A designates the direction of working travel of the flat bars 14 as their clothing cooperates with the clothing of the main carding cylinder 4.

Figure 2:
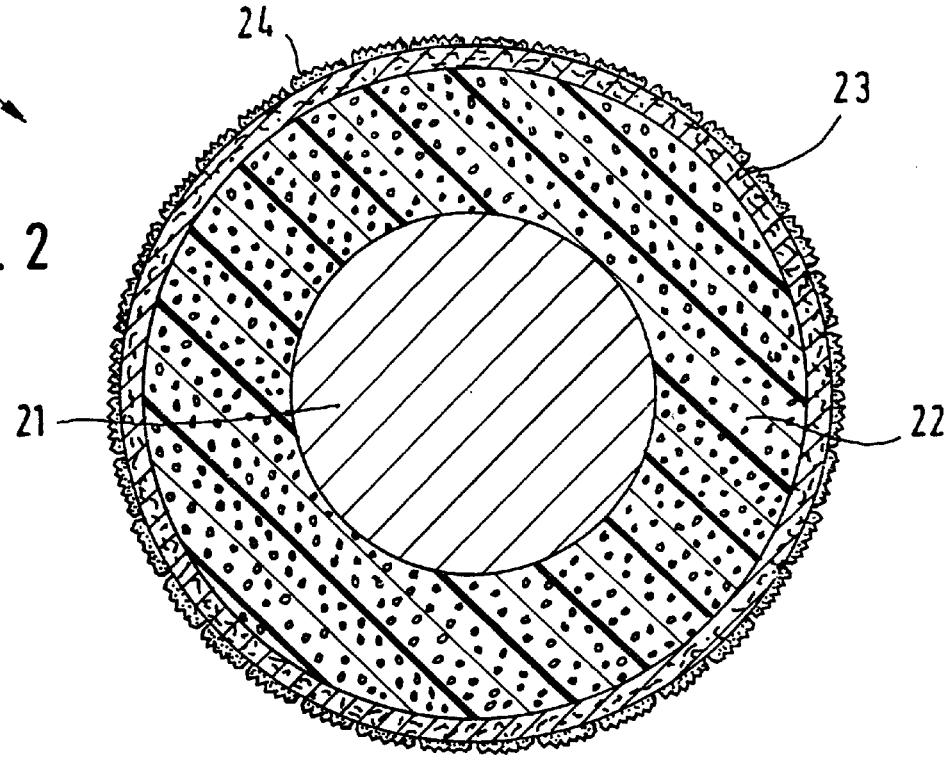
FIG. 2 is a sectional end elevational view of a material-removing roll according to the invention.

Turning to FIG. 2, the material-removing roll R is composed of a rigid core 21 which may be a tube or a rod of solid cross section made of steel and a soft-elastic jacket 22 surrounding the core 21 and made, for example, of foam material and serving as a cushion. The jacket 22, in turn, is surrounded by a circumferential layer 23 which carries a material-removing (grinding, polishing or cleaning) substance 24 such as, for example, corundum sanding grains. The layer 23 is a textile carrier made of a woven or knit textile fabric wound around the resilient jacket 22. The fabric may be a strip significantly less in width than the axial length of the roll R, in which case the fabric is helically wound on the resilient jacket 22. The textile carrier layer 23 is elastic at least in one direction of its fabric. For this purpose an elastic yarn (such as Elastan) is used. The woven or knit fabric structure of the textile carrier 23 is selected such that an elasticity of the carrier surface at least in one direction is obtained. The total elasticity of the upper face of the material-removing roll R which is composed of the elasticity of the jacket 22, the substance-carrying surface of the layer 23 and the elasticity of the carrier fabric of the layer 23 is so selected that the pressing grinding forces may be maintained within certain limits without the need of a highly precise positioning of the material-removing roll R relative to the clothing points 14*a* when using the material-removing roll R as the grinding roll 17. The pressing forces may be limited by providing that such forces are applied only by the roll weight; for this purpose, the roll 17 is swingably held by its supports. By virtue of the elasticity of the grinding surface the individual pins 14*a* of the flat bar clothing which project to a greater extent may radially inwardly deform the grinding surface to such an extent that even those pins 14*a* which project to a lesser extent will be in contact with the grinding surface. The grinding roll 17 may be a permanently installed part of the carding machine 1 (FIG. 1) and may be positioned normally such that it does not continuously contact the points of the clothing pins 14*a*. Controlled by the machine program or by manual actuation, the grinding roll 17 may be, during the carding operation, brought into contact with the clothing points of the flat bars 14 for a predetermined period, such as more than one revolution of the traveling flats. It is not necessary to bring the roll 17 into an exact grinding position (such as to the accuracy of a few hundredths of a millimeter), and therefore not all elements of the roll guide, roll holding device and abutments need be made and set with high precision. The elastic construction of the grinding roll 17 takes into account that the individual pins 14*a* of the flat bar clothing project or are recessed to a non-uniform extent. The soft elasticity thus results in technological and economical advantages.

When using the material-removing roll R as a cleaning roll, such as rolls 18, 19 for the crushing rolls 7 and 8, respectively, due to the elasticity of the cleaning rolls, a slight application pressure is obtained and the cleaning surface may conform to the deformations of the crushing rolls 7, 8 caused by the crushing forces. The surface of the cleaning rolls 18, 19 is selected such that a slight grinding or polishing effect is obtained. As the jacket layer 23, artificial leather, such as Alcantara or Vileda may be used.

Figure 3:
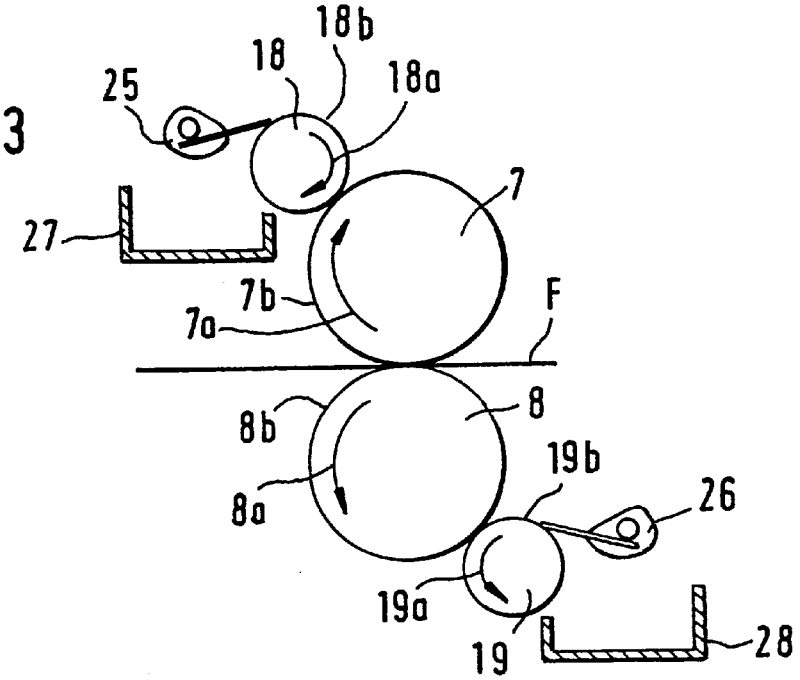
FIG. 3 is a schematic side elevational view of a crushing roll pair in which each crushing roll is associated with a cleaning roll structured according to the invention.

Each cleaning roll 18, 19 is, in turn, cleaned by an additional cleaning device which, as shown in FIG. 3, comprises strippers, such as stripping blades 25, 26. The cleaning rolls 18, 19 may clean the crushing rolls 7, 8 continuously or intermittently or cyclically along the crushing roll lengths. The dirt is collected in a gathering device 27, 28 or may be directly or indirectly drawn away by a non-illustrated suction device. When using the material-removing rolls R as cleaning rolls 18, 19 for the crushing rolls 7, 8, to the cleaning rolls adhesion-repellent materials (such as talcum or other powder) are applied which prevent the slightest sticking of the cleaning rolls to the crushing rolls 7, 8. The applied material may contain sugar-dissolving enzymes, particularly for removing honeydew fro m the crushing rolls. The rotary direction of the rolls 7, 8, 18 and 19 are designated with respective arrows 7*a,* 8*a,* 18*a* and 19*a*.

Figure 4:
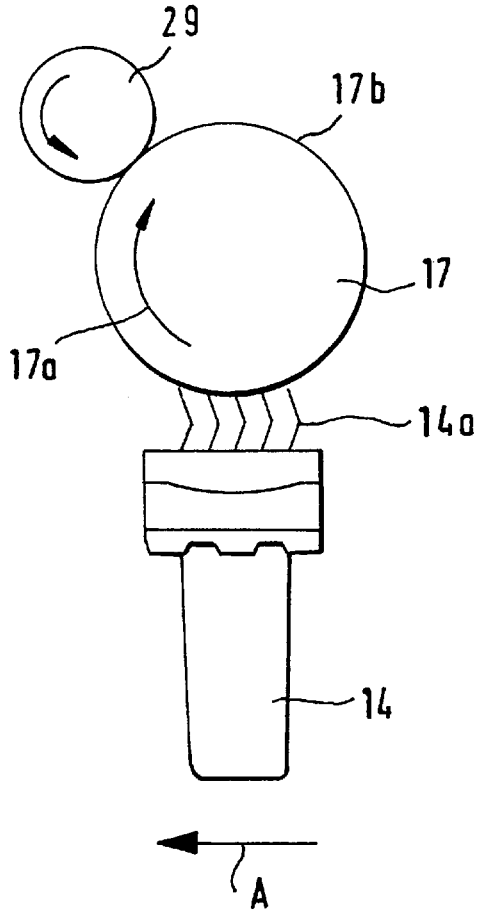
FIG. 4 is a schematic side elevational view of a grinding roll in contact with flat bar clothing points and cooperating with a stripping roll.

In FIG. 4 the material-removing roll R is a grinding roll 17 in engagement with the points of the flexible clothing 14*a* of the flat bars 14. 17*a* designates the direction of rotation of the grinding roll 17. The grinding roll 17 cooperates with a cleaning roll 29 which may be brush roll and which is in contact with the outer circumferential surface of the grinding roll 17.

Figure 4A:
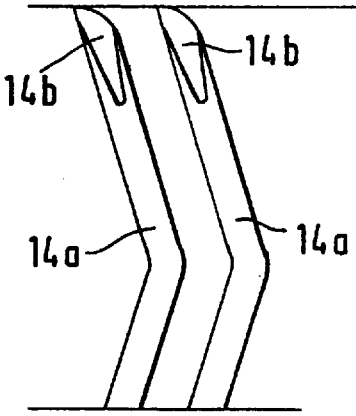
FIGS. 4*a,* 4*b* and 4*c* are schematic side elevational views of flat bar clothing points in a new, worn and resharpened condition, respectively.
Figure 4B:
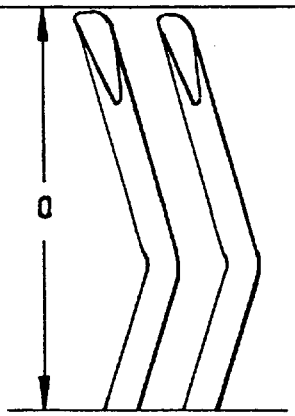
Figure 4C:
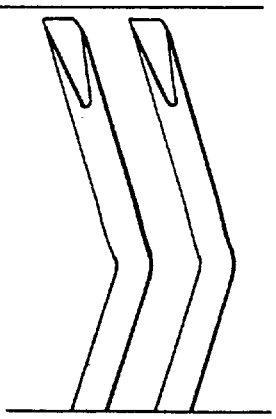

The points 14*b* of the flat bars 14*a* are shown in FIG. 4*a* in their new (unused) condition, in FIG. 4*b* they are illustrated in a worn state and in FIG. 4*c* in a resharpened state. The distance between the point 14*b* and the securing surface of the clothing 14*a* is designated at a.

Turning to FIG. 5, the cleaning rolls 18 and 19 are rotated by drives 30 and 31, respectively. The drives 30, 31 may be driven by a non-illustrated common prime mover such as an electric motor.

Turning to FIG. 6, the grinding roll 17 is coupled to a driving pulley 33 by means of a drive belt 32. The driving pulley 33 is mounted coaxially with a driving pulley 34 for the main carding cylinder 4 which, in turn, is coupled by a drive belt 35 to a drive, for example, an electric motor 36.

The essential feature of the material-removing roll R, whether used as a grinding roll 17 or a cleaning roll 18, 19, is the elastically yielding pressure it exerts on the components treated thereby. Such an elastically yielding pressure results in conforming the roll surface to the shape and height of the items to be ground or rubbed. In this manner, material removal is achieved accompanied by a polishing effect.

The clothings 14*a* and the crushing rolls 7, 8 are thus treated by grinding or rubbing, respectively. From the clothing 14 essentially metallic material and from the crushing rolls 7, 8 essentially dirt is removed by grinding (grinding roll 17) or, respectively, rubbing (cleaning roll 18, 19).

It will be understood that the above description of the present invention is susceptible to various modifications, changes and adaptations, and the same are intended to be comprehended within the meaning and range of equivalents of the appended claims.

What is claimed is:

1. In a fiber processing machine including a fiber processing component and a material-removing roll supported to be in contact with said fiber processing component for removing material therefrom; the improvement wherein said material-removing roll comprises (a) a core of a hard material;

(b) an elastic jacket mounted on said core; said elastic jacket having a radially deformable resilient circumferential surface;

(c) a soft-material outer layer surrounding said elastic jacket; and (d) a material-removing substance carried by said soft-material outer layer.

2. A fiber processing machine as defined in claim 1, further comprising stationary bearings for fixedly supporting said material-removing roll.

3. A fiber processing machine as defined in claim 1, further comprising displaceably held bearings for shiftably supporting said material-removing roll.

4. A fiber processing machine as defined in claim 3, wherein said material-removing roll is in engagement with said fiber processing component with a pressing force generated by a weight of said material-removing roll.

5. A fiber processing machine as defined in claim 1, wherein said hard material is selected from the group consisting of steel, aluminum and plastic.

6. A fiber processing machine as defined in claim 1, wherein said elastic jacket is a hose surrounding said core and is of a material selected from the group consisting of a foam material, cellular rubber and foamed silicone.

7. A fiber processing machine as defined in claim 1, wherein said material-removing substance is carried on an outer surface of said outer layer.

8. A fiber processing machine as defined in claim 1, wherein said material-removing substance is integrated in said outer layer.

9. A fiber processing machine as defined in claim 1, wherein said outer layer is a strip wound on said elastic jacket.

10. A fiber processing machine as defined in claim 1, wherein said outer layer is a textile fabric.

11. A fiber processing machine as defined in claim 1, wherein said textile fabric is resilient in at least one direction.

12. A fiber processing machine as defined in claim 1, further comprising a cleaning element cooperating with an outer surface of said material-removing roll.

13. A fiber processing machine as defined in claim 12, further comprising means for continuously maintaining said cleaning element in contact with said material-removing roll.

14. A fiber processing machine as defined in claim 12, where in said cleaning element is a scraper blade.

15. A fiber processing machine as defined in claim 12, wherein said cleaning element is a rotary cleaning roll.

16. A fiber processing machine as defined in claim 1, wherein said fiber processing machine is a carding machine having a main carding cylinder and traveling flats composed of flat bars having a clothing cooperating with the main carding cylinder; further wherein said material-removing roll is a grinding roll cooperating with said flat bars for sharpening clothing points of said clothing.

17. A fiber processing machine as defined in claim 1, wherein said fiber processing machine is a carding machine having a pair of cooperating crushing rolls between which a fiber web produced by the carding machine passes; further wherein said material-removing roll is a cleaning roll cooperating with one of said crushing rolls for removing impurities therefrom.

* * * * *